US005996590A

United States Patent [19]

Steege

[11] Patent Number: 5,996,590

[45] Date of Patent: Dec. 7, 1999

[54] CONICAL FINGERNAIL FILE

[76] Inventor: Melissa L. Steege, 1125 Smith Ave., Nampa, Id. 83651

[21] Appl. No.: 09/071,505

[22] Filed: May 1, 1998

[51] Int. Cl.[6] ..... A45D 29/18; A45D 29/00

[52] U.S. Cl. ..... 132/76.4; 132/73; 132/73.5; 132/75.6

[58] Field of Search ..... 132/76.4, 73, 73.5, 132/75.6; 433/142

[56] References Cited

U.S. PATENT DOCUMENTS

| | | | |
|---|---|---|---|
| 2,233,438 | 3/1941 | Troya | 132/76.4 |
| 3,131,701 | 5/1964 | Emerson | 132/76.4 |
| 3,298,381 | 1/1967 | Adams | 132/76.4 |
| 3,809,101 | 5/1974 | Shimizu | 132/76.4 |
| 4,459,987 | 7/1984 | Pangburn | 128/355 |
| 4,683,898 | 8/1987 | Lojovich | 132/76.4 |
| 4,765,350 | 8/1988 | Moore | 132/88.5 |
| 5,163,455 | 11/1992 | Pointe et al. | 132/76.4 |
| 5,439,013 | 8/1995 | Hoover | 132/76.5 |
| 5,666,981 | 9/1997 | Stephens | 132/76.4 |

OTHER PUBLICATIONS

Titan diamond riffle files, Dec. 1985.

*Primary Examiner*—John J. Wilson
*Assistant Examiner*—Robyn K Doan
*Attorney, Agent, or Firm*—Frank J. Dykas; Robert L. Shaver

[57] ABSTRACT

A conical nail file having a handle and two conical files each formed of a convex conical surface and concave conical surface confocally arranged to terminate in a conical apex is provided and designed to interfit underneath an acrylic nail and reach and file the area of the acrylic nail adjacent to the free end of the natural fingernail and the nail bed.

2 Claims, 2 Drawing Sheets

CONICAL FINGERNAIL FILE

BACKGROUND OF THE INVENTION

1. Technical Field

This invention generally relates to fingernail files, and more particularly to a conical nail file for filing the underside of a nail adjacent to the cuticle.

2. Background

Long, manicured painted fingernails have been popular throughout humankind's history. The traditional way of creating long, manicured fingernails is to allow them to grow, and to carefully care for them by filing to keep them in proper shape and by periodic painting with fingernail polish. However, there now exists a number of alternatives to the natural, long fingernail, including the acrylic or artificial fingernail formed either with the aid of an artificial fingernail tip which is attached to the natural fingernail, or simply by molding or sculpting an acrylic fingernail which itself is directly attached to the tip.

In both cases, the natural fingernail is first prepared by filing it and etching it with an acid, and then washing it with alcohol to prepare a clean surface to which an adhesive and/or the acrylic material will adhere. Typically, this is done with a traditional flat nail file followed by a wash in alcohol, and the application of a priming chemical, typically acid based, such as methacrylic acid in solution with iso butyl methacrylate.

Once the fingernail has been prepared, a liquid acrylic solution, which will harden and eventually form the final acrylic fingernail, is prepared by the mixture of an acrylic polymer with an acrylic monomer, such as acrylic ester polymer and benzoyl peroxide silica with acrylic ester monomer with NN4 diamethyle P and toludine 0 hydroxy benzophenone. The combination forms a plastic acrylic which can be applied using a small brush to the natural fingernail and sculpted with a brush. This type of acrylic will harden generally within a few minutes, and repeated applications of additional acrylic material can eventually be formed into a natural looking, but long and sculpted, acrylic fingernail.

The acrylic material can be applied either atop a plastic fingernail tip, which has been glued using various adhesives to the natural fingernail, or simply attached directly to the primed natural fingernail and sculpted to form a long, acrylic fingernail.

In the case where the tip is not used and a sculpted fingernail is desired, oftentimes the manicurist will use a temporary bridge-like mold or form, which is positioned in front of and adjacent to the natural fingernail to support the sculpted acrylic fingernail until such time as it hardens and is able to remain in place without the aid of a mold.

Once the acrylic fingernail has been formed using the brush, it is filed using traditional flat fingernail files of varying grits, starting with a coarse grit and ending with the finest of grits to form the finished fingernail. The finished acrylic fingernail is then painted an appropriate color and the formation of the acrylic fingernail is completed.

In both cases, the use of acrylic material can often result in the sealing off of the area between the cutis or nail bed and the free end of the natural fingernail. This is both unsightly, and also presents hygienic problems, particularly with respect to the developments of molds and funguses between the natural nail and the nail bed. Therefore, it is necessary, once the acrylic fingernail has been formed, to file out the area between the acrylic fingernail and the natural nail bed to open it up to the same degree that it naturally would be with a short, manicured, natural fingernail. It is difficult to reach this area on the underside of the fingernail, since it is a concave surface and not easily filed or cleaned using a traditional flat fingernail file.

Some of the prior art solutions are to use a metal or wooden pick, and even a conventional power routing tool with a fine router bit. However, all of these prior art solutions pose some danger of injury to the end of the finger and/or the nail bed and have generally not proven to be satisfactory.

Accordingly, what is needed is a fingernail file specifically designed to reach into and file the concave underside surface of the acrylic fingernail adjacent to the free end of the natural fingernail and nail bed.

DISCLOSURE OF INVENTION

These objects are achieved in an improved conical nail file intended for use to file the concave underside surface of a sculpted acrylic fingernail. It is formed of a handle body and two conical nail assemblies, each formed of two confocal conical surfaces which terminate confocally in a conical apex. The two nail assemblies are of differing sizes, and each is designed to interfit underneath the acrylic nail and reach and follow the area of the acrylic nail adjacent to the free end of the natural fingernail and nail bed. Both conical nail files are provided with an abrasive material of predetermined grit, which is bonded to them, and of sufficient hardness to adequately remove acrylic material from the area adjacent to the free end of the natural nail and nail bed. The rounded conical surfaces are each sized to conform to the concave under surface of the sculpted acrylic fingernail. The rounded concave conical surfaces are configured for use in sculpting and filing the upper surface of the acrylic fingernail, and the confocal apex is configured to reach the area adjacent to the free end of the natural fingernail and nail bed.

BEST MODE FOR CARRYING OUT INVENTION

Figure 1:
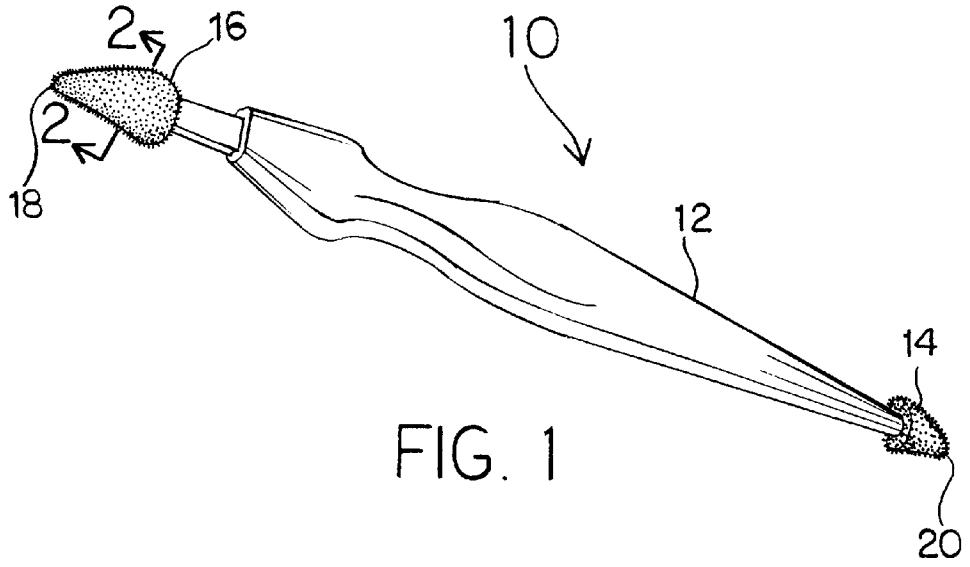
FIG. 1 is a perspective representational view of the conical nail file.
Figure 2:
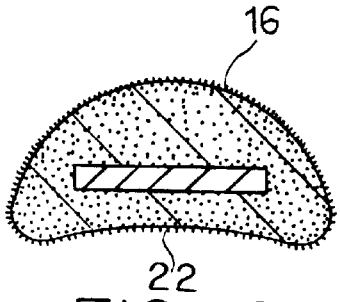
FIG. 2 is a sectional side view of a conical nail file taken along the plane 2—2 of FIG. 1.
Figure 3:
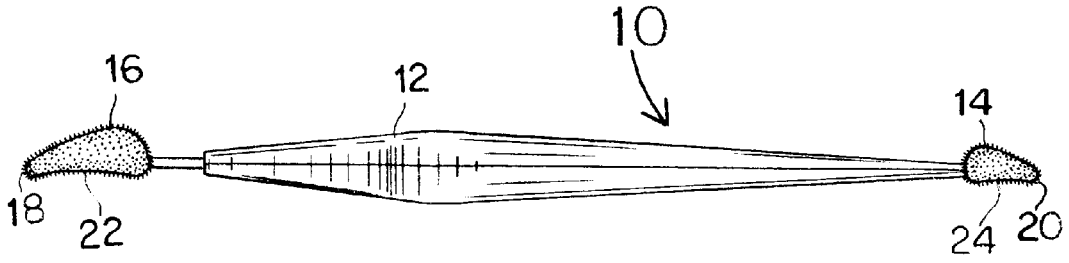
FIG. 3 is a side view of the conical nail file.
Figure 4:
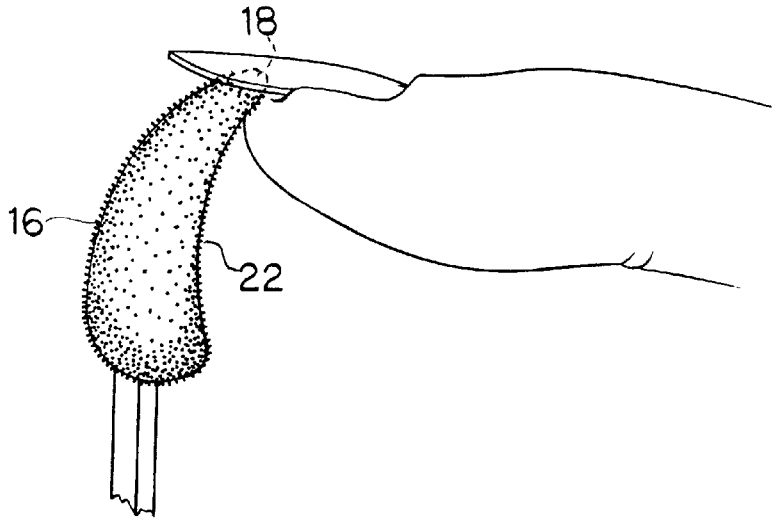
FIG. 4 is a representational perspective view of a conical nail file in use.
Figure 5:
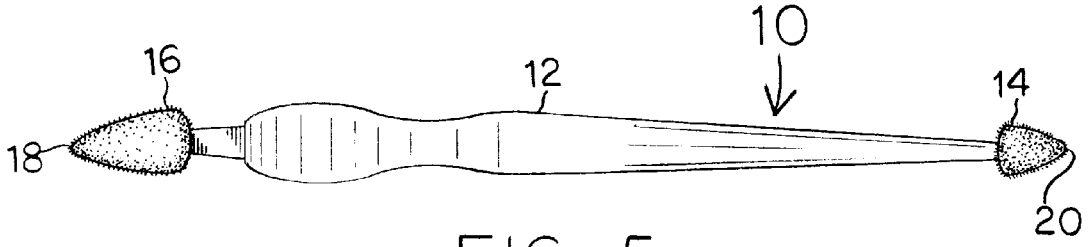
FIG. 5 is a top plan view of a conical nail file.
Figure 6:
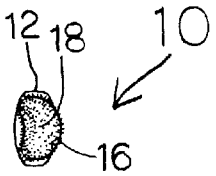
FIG. 6 is a first end view of a conical nail file.
Figure 7:
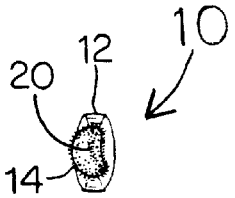
FIG. 7 is a second end view of a digital nail file.

There is shown in FIGS. 1 through 7 improved conical nail file 10 intended for use to file the concave underside surface of a sculpted acrylic fingernail. It is formed of handle body 12 and two conical nail assemblies, each formed of two confocal conical surfaces. The first is the larger of the two file assemblies formed of convex conical surface 16 overlaying concave conical surface 22 and terminating confocally, in a conical apex 18. The second is a smaller size, and is formed of convex conical surface 14, confocally joined with second concave conical surface 24 and terminating at conical apex 20. Each is designed to interfit underneath an acrylic nail, as shown in FIG. 4, and reach and follow the area of the acrylic nail adjacent to the free end of the natural finger nail and nail bed. Both conical nail files are provided with an abrasive material of predetermined grit, which is bonded to them, and of sufficient hardness to adequately remove acrylic material from the area adjacent to the free end of the natural nail and nail bed. The rounded convex conical surfaces 16 and 14 are each sized to conform also to the concave under surface of the sculpted acrylic finger nail.

The nail file 10 can also be used for filing the top surface of the nail bed utilizing concave conical surfaces 22 and 24, and also, using apexes 18 and 20, to file the top surface of the nail adjacent to the cuticle edge to shape the inside edge to a correct acrylic build-up, or to reduce excessive amounts of nail polish.

While there is shown and described the present preferred embodiment of the invention, it is to be distinctly understood that this invention is not limited thereto but may be variously embodied to practice within the scope of the following claims.

I claim:

1. A nail file which comprises:

a handle having first and second ends;

a first conical shaped file of predetermined grit and size attached to and extending out from said first end of said handle; and a second conical shaped file of a smaller predetermined size and a predetermined grit attached to and extending out from said second end of said handle.

2. The nail file of claim 1 wherein each of said conical shaped file further comprises:

a file body formed between at least two confocal conical surfaces with the first of said conical surfaces having a convex outer surface and the second conical surface having a concave outer surface; and a grit of predetermined size adhered to each of said outer surfaces.

* * * * *